United States Patent [19]

Wingerter

[11] Patent Number: 4,559,958

[45] Date of Patent: Dec. 24, 1985

[54] APPARATUS FOR STORING FLAT AND PREFERABLY CIRCULAR OBJECTS

[75] Inventor: Franz Wingerter, Berlin, Fed. Rep. of Germany

[73] Assignee: Heinrich H. Klussendorf GmbH & Co. KG, Fed. Rep. of Germany

[21] Appl. No.: 611,098

[22] Filed: May 17, 1984

[30] Foreign Application Priority Data

May 18, 1983 [DE] Fed. Rep. of Germany ..... 3318124

[51] Int. Cl.[4] ..... G07D 9/04

[52] U.S. Cl. ..... 133/4 A; 221/86

[58] Field of Search ..... 133/4 R, 5 R, 4 A; 221/75, 86

[56] References Cited

FOREIGN PATENT DOCUMENTS 2142193 8/1970 Fed. Rep. of Germany .

2752313 7/1978 Fed. Rep. of Germany .

*Primary Examiner*—Stanley H. Tollberg

*Attorney, Agent, or Firm*—Basile, Weintraub & Hanlon

[57] ABSTRACT

An apparatus for storing coins is provided with slot-like openings for the insertion and dispensing thereof, as well as for the removal of the overflow. The coins are stored between two concentric rings, each of which has a helical slot on the facing faces thereof. The individual coins are held by the limiting surfaces of these slots. The gap between the two rings is subdivided into individual compartments by the vanes of a rotary impeller and the length thereof corresponds roughly to a coin diameter. As a result of this arrangement, the coins are stored in succession and also in juxtaposed manner. The insertion and dispensing of coins takes place by a corresponding controlled rotation of the impeller, the rotation for insertion taking place in one direction and that for dispensing in the other direction.

7 Claims, 2 Drawing Figures

APPARATUS FOR STORING FLAT AND PREFERABLY CIRCULAR OBJECTS

BACKGROUND OF THE INVENTION

I. Field of the Invention

The invention relates to an apparatus for storing flat and in particular circular objects, especially coins, with slot-shaped openings for inserting and dispensing the objects, as well as for removing the overflow, in which the objects are arranged within circular compartments rotatable about a concentric axis. The compartments have limiting surfaces in the direction of this axis which pass helically about the concentric axis so that the plane of the stored objects is perpendicular to the concentric axis and around which the compartments are rotated. Thus, a plurality of successive compartments are formed in the axial direction. The openings for insertion and dispensing of the objects are in one plane perpendicular to the axis on one side of the helical arrangement of the limiting surfaces and the opening for the overflow is located in a plane parallel thereto on the other side of the helical arrangement of the limiting surfaces, whereby compartments are made ready for the objects to be inserted by moving the compartments in one rotation direction and are made ready for dispensing the stored objects by moving the compartments in the other rotation direction.

II. Description of the Prior Art

It is known to store coins in so-called coin shafts, which are filled from above and from which coins can be removed at the bottom with the aid of special removal means. The removal means have reciprocating slides enabling the lowermost coin of a column located in a shaft to be removed. These storage means suffer from numerous disadvantages. If a large number of coins are to be stored, then the necessary shaft height is very considerable, so that a large amount of space is required. In addition, there is a risk of coins jamming in the shafts. The dispensing of the coins takes place relatively slowly, because the slide must be moved backwards and forwards for each coin. As the dispensing device must be set very accurately to the particular coin thickness, even slightly bent coins can cause considerable difficulties during dispensing. Another factor which has to be taken into consideration on dispensing is the weight of the coin column, which can vary considerably as a function of the number of coins in the shaft. In addition, special intermediate stores are required if, in the case of any coin return, those coins have to be dispensed which were introduced last.

The aforementioned disadvantages are avoided by the money changer or cash dispenser disclosed in German Pat. No. DE-05 27 52 313, in which the coin magazine for each coin type has a ring mounted in a rotary manner with at least approximately radial compartments uniformly distributed around the ring circumference and which are formed between compartment walls projecting on a flat circular ring and which in each case receive a single coin. On each compartment ring is provided an insertion channel outlet, a return channel inlet and an overflow channel inlet. The outlet and the two inlets are in each case displaced with respect to one another by one compartment spacing of the ring. In order to fill the ring with coins, the latter is turned in one direction, while the dispensing of stored coins takes place by turning in the other direction. As the coins drop as a result of their own weight when inserted into the compartments located below the insertion channel outlet and on so dispensing drop from the particular compartment into the return channel inlet, there is no need for special means for displacing the coins during insertion or dispensing. However, even this known cash dispenser or money changer suffers from disadvantages. In the case of a very large number of coins to be stored, there is a correspondingly large compartment ring diameter, which is contrary to the requirement of a compact coin storage means. Another disadvantage is the relatively slow dispensing speed. As the longitudinal axis of the insertion and/or dispensing slots is perpendicular to the rotation movement of the compartment ring, the latter must be stopped in the particular position for inserting or dispensing a coin and must remain in this position until the coin has reliably dropped into the compartment or out of the same. If it is not ensured that the particular coin has completely dropped into the compartment or has passed out of it, the means can be considerably damaged in the case of a premature further movement of the compartment ring. In addition, the coins cannot be inserted in an uninterrupted sequence and instead only a single coin can be introduced following each compartment ring step, because there would otherwise be a danger of the compartment ring being locked by a jammed coin. Therefore, the insertion and dispensing of the coins can only take place relatively slowly. In addition, considerable precision requirements are made on the known means, because there must be precise alignment of the compartments in the insertion or dispensing position with the associated channel inlets or the channel outlet. As the compartment or channel width corresponds to the width of the particular coins, i.e. is very small, the reciprocal alignment must be very accurately carried out. Even a minor displacement can mean that insertion or dispensing is made very difficult or even impossible.

An example of the aforementioned apparatus is disclosed in DE-AS 21 42 193. This apparatus has one slit for both inserting and dispensing coins.

This inevitably leads to the conclusion that neither the insertion nor the dispensing of coins can be accomplished entirely by means of their weight. As here the dispensing of coins takes place using the effects of gravity, a special device has to be provided for insertion, in order to push the coins into the storage apparatus against the pull of gravity. The apparatus according to the prior art has a relatively elaborate device, namely, a revolving closure device and its control, as well as several levers, an impelling rod and a control unit including a cam disc, and a cam follower. This elaborate mechanism does not permit quick and friction-free insertion of the objects

SUMMARY OF THE INVENTION

It is therefore an object of the present invention to provide an apparatus for storing flat, circular objects, which is very compact and therefore space-saving and simple in construction and which makes it possible to rapidly insert and dispense the objects. Moreover, no unusually high demands are to be made on the mechanical precision of the apparatus.

According to the invention, this object is accomplished by having the plane of the stored objects perpendicular to the concentric axis about which the compartments are rotated, wherein the insertion opening is located above the movement path of the compartments and the dispensing opening below the movement path of the compartments, requiring a rotational angular displacement to dispense the stored object which is not greater than the angle defined by the vanes of one compartment, and at least sufficiently large that a direct drop-through of an object from the insertion opening to the dispensing opening is not possible.

According to this advantageous construction, the outer and inner, as well as the lateral, limiting surfaces of the compartments are axially formed by two fixed concentric rings, in such a way that there is a helical slot on the inner face of the outer ring and a corresponding slot on the outer face of the inner ring.

BRIEF DESCRIPTION OF THE DRAWINGS

The invention is described in greater detail hereinafter relative to a non-limitative embodiment shown in the drawings, wherein.

DESCRIPTION OF THE PREFERRED EMBODIMENT

Figure 1:
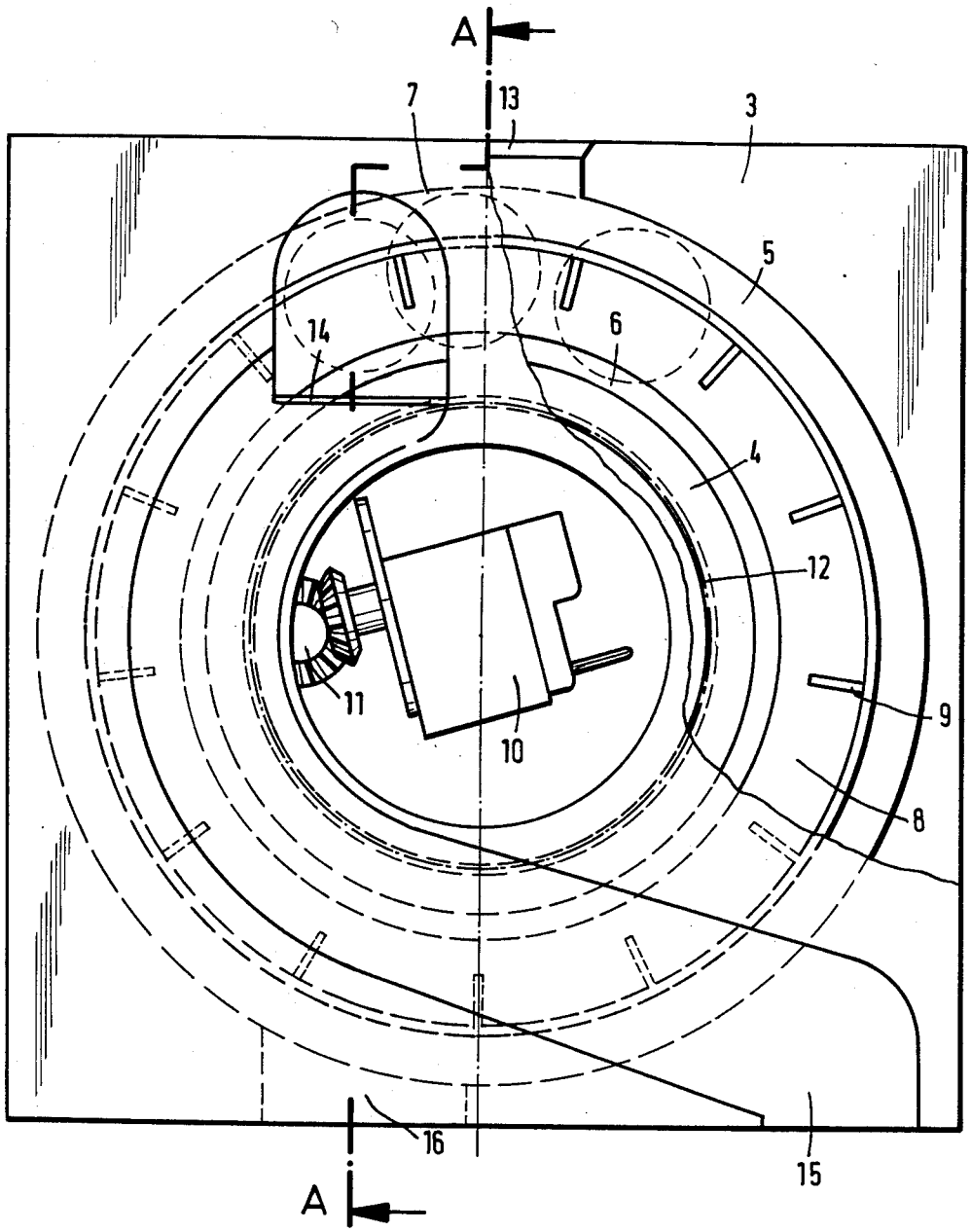
FIG. 1 is a partial plan view and vertical partial section through an apparatus for storing flat, circular objects.

The preferably square apparatus has a front plate 1 and a rear plate 2, between which there are two fixed concentric rings 3 and 4. On the inner face of the outer ring is provided a helical slot 5, which extends between the two plates 1 and 2. On the outer face of the inner ring 4 is provided a slot 6 constructed in the same way. Slots 5 and 6 face one another, so that a coin 7 positioned between rings 3 and 4 is kept in the vertical position by these slots.

An impeller 8 is held in a rotary sliding manner in inner ring 4. By the suitable choice of the materials of ring 4 and impeller 8, the friction between them can be kept extremely small. Impeller 8 is moved past inner ring 4 adjacent to rear plate 2. In the area between rings 3 and 4, it carries vanes 9 projecting into the space between them. The distance between the individual vanes in the circumferential direction is slightly larger than the diameter of the coins to be received. Thus, vanes 9 circumferentially form compartments for receiving in each case one coin. In addition, the helical arrangement of slots 5 and 6 in rings 3 and 4 ensures that there are successively several compartments for receiving in each case one coin between in each case two adjacent vanes 9 in the direction of the rotation axis of the impeller.

Figure 2:
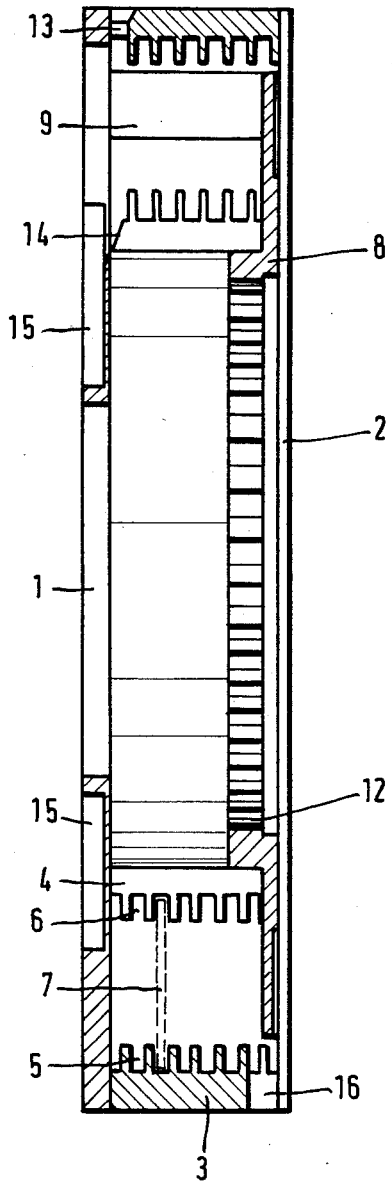
FIG. 2 is a vertical section A—A through the apparatus with a sectional plane displaced by 90° compared with that of FIG. 1.

For driving the impeller 8, a motor 10 is located in the inner space formed by the latter. By means of a gear 11, the latter engages in internal toothing 12 of impeller 8. In order not to over complicate FIG. 2, motor 10 and gear 11 are not shown therein. Motor 10 is controlled in an appropriate manner for performing coin storage or dispensing operations. This control can, e.g. in per se known manner, take place by means of a not shown coin checker, which checks the inserted coins, establishes their value, passes the same to the corresponding storage means and then controls the storage process by the corresponding control of motor 10. If a desired number of coins is to be dispensed, a corresponding control signal is received by motor 10. Motor 10 cooperates with a not shown photoelectric scanner, which detects markings on the impeller 8 during the rotation thereof. This makes it possible to control in a desired manner the rotation movement and the particular position of the impeller.

Motor 10 and gear 11 are constructed in such a way that they are located in a space formed by plates 1 and 2. It is therefore possible to arrange a plurality of the shown apparatuses in direct succession in the axial direction of the impeller. Preferably, each of the said apparatuses is provided with its own drive.

On the side of outer ring 3 facing the front plate 1 an insertion opening 13 is located at the uppermost point thereof. This opening is slot-shaped, its longitudinal direction being parallel to plate 1. A coin introduced through the insertion opening drops into the outermost left-hand compartment in FIG. 2 and which is formed by the two vanes 9 positioned laterally below said opening. Impeller 8 is controlled in such a way that, following the insertion of a coin, it is always rotated by a single compartment spacing, so that there is always a free compartment below the insertion opening 13.

On inner ring 4 and somewhat displaced below the insertion opening 13 is provided an edge 14 sloping with respect to plate 1 and which issues into a dispensing channel 15 located in said plate. This dispensing channel runs in curved form from edge 14 to the lower edge of plate 1 and is indicated by broken lines in FIG. 1. Edge 14 is in the same plane as insertion opening 13 and ensures that a coin located in the outermost left-hand compartment according to FIG. 2 and positioned over edge 14 is passed by its own weight into dispensing channel 15. Insertion opening 13 and edge 14 are displaced with respect to one another by less than one compartment spacing in the rotation direction. However, this is sufficient for a coin inserted in insertion opening 13 not to pass over edge 14 into dispensing channel 15 without an additional rotation of impeller 8.

Adjacent to the rear plate 2, outer ring 3 forms an overflow channel 16 in the lower area of the apparatus which, in each case, connects with the outermost right-hand compartment located in the vicinity of said channel with an overflow opening on the bottom of the indicated apparatus. The plane of overflow channel 16 is parallel to plates 1 and 2.

The apparatus operates as follows. To insert a coin, impeller 8 is rotated clockwise according to FIG. 1. The coins are simultaneously inserted through insertion opening 13. If several coins are introduced in succession, then the impeller rotates by a corresponding number of compartment spacings without it being necessary to stop for the insertion of the individual coins. This permits an uninterrupted, very rapid insertion of coins, which do not have to be individually fed in. Impeller 8 is controlled in such a way that it is rotated by one compartment spacing following the insertion of the last coin, so that there is always a free compartment below the insertion opening. Impeller 8 is rotated counterclockwise for dispensing coins. The compartments immediately adjacent to plate 1 and which are moved past edge 14 are emptied. The coins drop out of the particular compartment during rotation, so that here again there is no need to stop the impeller. Thus, the dispensing operation can also be performed at high speed and it is always ensured that the last-inserted coins are dispensed first.

If the apparatus is full, i.e. if all the compartments in the circumferential direction and axial direction are occupied, on further coin insertion, i.e. a clockwise rotation of the impeller, the coins located in the compartments moved directly past overflow channel 16 are dispensed by means of the latter. Here again, dispensing takes place without any additional control means during the rotation of impeller 8.

Thus, insertion and dispensing take place in a very simple manner by merely bringing about a corresponding controlled rotation of the impeller. During the rotary movement, the coins fall into or out of the particular compartments, so that there is no need for an intermittent movement of the impeller between the individual compartments, so that insertion and dispensing take place at high speed.

The driving force required for the impeller is very low, so that motor 10 can be very small. As the coins often roll on the surface on which they are supported during the rotation of the impeller, the force necessary for transporting the coins is extremely small. The apparatus can be automatically brought into a basic position following a power failure through the use of the photoelectric scanner. Thus, normal operation can be automatically resumed following an interruption to the power supply.

The motor for driving the impeller can be e.g. replaced by a latch operable by an electromagnet. The represented coin storage means is very compact and is suitable for slide-in technology as a result of the shape. Preferably, several such means are directly juxtaposed, the front plate 1 of one means and the rear plate 2 of the adjacent means being directly in engagement. Each apparatus is preferably provided for the storage of a specific coin type. The connector between an apparatus and the common control device can be correspondingly coded, so that the apparatuses can be randomly interchanged. If different coins are to be stored in varyingly large numbers, then a different number of storage means can be used for the particular coin types. A filling level detection device can be associated with the storage means and counts the inserted and dispensed coins and forms the difference of the count values.

The storage means is not only suitable for circular objects, but also for polygonal and approximately circular objects.

I claim:

1. An apparatus for storing flat and in particular circular objects, especially coins, with slot-shaped openings for inserting and dispensing the objects, as well as for removing the overflow, in which the objects are arranged within circular compartments rotatable about a concentric axis, whereby the compartments have limiting surfaces in the direction of this axis and which pass helically about the concentric axis so that the plane of the stored objects is perpendicular to the concentric axis, around which the compartments are rotated, and so that a plurality of successive compartments are formed in the axial direction, the openings for insertion and dispensing are in one plane perpendicular to the axis on one side of the helical arrangement of the limiting surfaces and the opening for the overflow is located in a plane parallel thereto on the other side of the helical arrangement of the limiting surfaces, whereby compartments are made ready for the objects to be inserted by moving the compartments in one rotation direction and are made ready for dispensing the stored objects by moving the compartments in the other rotation direction.

2. The apparatus according to claim 1, wherein the overflow opening in the radial direction is located on the opposite side to the insertion and dispensing openings.

3. The apparatus according to claim 1, wherein the outer and inner, as well as the lateral limiting surfaces of the compartments, are axially formed by two fixed concentric rings, in such a way that a helical slot is provided on the inner face of the outer ring and a corresponding slot on the outer face of the inner ring.

4. The apparatus according to claim 3, wherein the lateral limiting surfaces of the compartments in rotation direction are formed by the vanes of an impeller rotatable about the concentric axis and which project into the gap between the inner and outer ring.

5. The apparatus according to claim 4, wherein the impeller is mounted so as to rotate and slide in the inner face of the inner ring.

6. The apparatus according to claim 1, wherein an insertion opening is located above the movement path of the compartments and a dispensing opening is located below the movement path of the compartments.

7. The apparatus according to claim 6, further comprising the lateral limiting surfaces of the compartments in rotation direction which are formed by the vanes of an impeller rotatable about the concentric axis, and wherein the rotational angular displacement required to dispense the stored object is not greater than the angle defined by the vanes of a a single compartment and at the same time the rotational angular displacement required is sufficiently large to prevent a direct drop-through of an object from the insertion opening to the dispensing opening.

* * * * *